United States Patent [19]

Newman et al.

[11] Patent Number: 4,719,774

[45] Date of Patent: Jan. 19, 1988

[54] DEADBOLT ASSEMBLY

[75] Inventors: Donald J. Newman, Sommerville; John A. Christie, Heathmont, both of Australia

[73] Assignee: Ogden Industries Pty. Ltd., Huntingdale, Australia

[21] Appl. No.: 943,362

[22] Filed: Dec. 16, 1986

[30] Foreign Application Priority Data

Dec. 18, 1985 [AU] Australia ..... PH3930

[51] Int. Cl.[4] ..... E05B 63/12

[52] U.S. Cl. ..... 70/131; 70/102; 70/142

[58] Field of Search ..... 70/102, 129, 131, 134, 70/142, 79; 292/340, 140, 169.17, DIG. 41

[56] References Cited

U.S. PATENT DOCUMENTS

| | | | |
|---|---|---|---|
| 921,785 | 5/1909 | Zimmerman | 292/340 |
| 1,983,446 | 12/1934 | Falk | 70/131 |
| 2,275,362 | 3/1942 | Golden | 70/134 |
| 3,141,319 | 7/1964 | Schlage | 70/134 |
| 4,607,510 | 8/1986 | Shanaan | 292/140 |

*Primary Examiner*—Robert L. Wolfe

*Attorney, Agent, or Firm*—Berman, Aisenberg & Platt

[57] ABSTRACT

A deadbolt assembly of the kind in which a deadbolt is mounted on a housing for linear movement between inoperative and inoperative positions in which the deadbolt engages with and does not engage respectively, a strike. An actuator is rotatably mounted on the housing and is drivably connected to the actuator through a drive plate which rotates in response to operation of the actuator, and a drive pin is secured to the plate at a position radially outwards of the rotational axis of the plate. The pin locates within a non-circular hole provided in the deadbolt and reacts against edges of that hole to cause the deadbolt movement. The pin moves along an arcuate path between each of its two extreme positions, and at each of those positions the pin lies on a straight line which extends substantially parallel to the direction of movement of the deadbolt and which substantially intersects the rotational axis of the drive plate. Both the deadbolt and the strike can be made from steel or other strong metal.

21 Claims, 7 Drawing Figures

DEADBOLT ASSEMBLY

Figure 1:
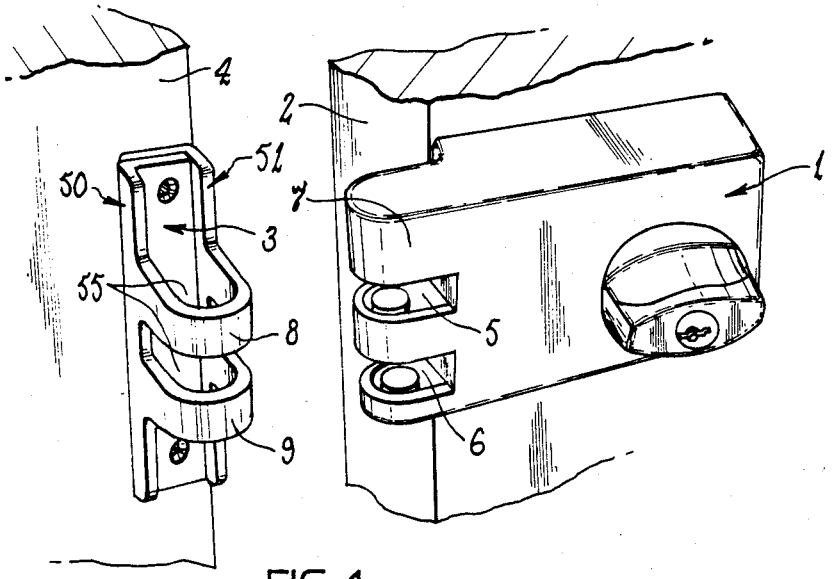

This invention relates to deadbolt assemblies of the kind used to releasably secure a door, for example, in a closed position. The invention is particularly concerned with such assemblies of the kind which, when in use, have the deadbolt arranged for movement in a direction substantially parallel to an upright edge of the associated door.

In assemblies of the foregoing kind the deadbolt is slidably mounted in a housing having two vertically spaced recesses for receiving respective parts of a strike. The deadbolt has two parts each of which is arranged to extend across a respective one of the housing recesses when the deadbolt is in its operative position. In the inoperative position of the deadbolt, each part of that bolt is withdrawn into the housing to leave the aforementioned recesses clear for movement of the strike into and out of the recesses. Each strike part has an aperture which is able to receive a respective part of the deadbolt when those strike parts are properly located in the housing recesses.

A deadbolt assembly usually includes inside and outside actuators. The outside actuator is typically a key operated lock, whereas the inside actuator can be either a manually operable turn knob or a key operated cylinder. If a turn knob is employed the deadbolt assembly may also include a security feature which is selectively operable to hold the turn knob against rotation or otherwise render it ineffective for operation of the deadbolt from the inside of the door.

The mechanism through which the actuators drive the deadbolt between its operative and inoperative positions has not been satisfactory. In particular, such mechanisms have not been sufficiently positive in operation and have been of complex construction and therefore expensive. Furthermore, the nature of the mechanism has been such that it places severe limitations on the manner by which the assembly housing can be fixed to a door. The result is that the housing cannot be fixed with adequate security.

It is an object of the present invention to provide an assembly of the foregoing kind in which the mechanism is more positive in operation than prior mechanisms of the same kind and which is relatively inexpensive. It is a further object of the invention to provide an improved means of fixing the assembly housing to a door, for example.

In accordance with the present invention, there is provided a deadbolt assembly including, a housing, a deadbolt mounted on said housing for linear movement relative thereto between operative and inoperative positions, a non-circular opening provided in said deadbolt, an actuator mounted on said housing, a drive plate rotatably mounted on said housing and being connected to said actuator so as to rotate in response to operation of said actuator, and a drive pin fixed to said drive plate so as to move therewith and being located radially outwards from the axis of said plate rotation, and means on said deadbolt cooperating with said pin so that said pin is adapted to push against said deadbolt and thereby cause said linear movement thereof as said plate is rotated.

In a preferred arrangement, the pin is eccentrically located on a rotatable disc and that disc can be drivably connected to the inside and outside actuators in any appropriate fashion. Assuming the inside actuator is a turn knob, it may be connected to the disc in the manner described in our copending patent application entitled "Improved Lock Bolt Mechanism", filed 18th Dec., 1985, and in particular that connection may include an overriding clutch as described in the copending application.

An embodiment of the invention is described in detail in the following passages of the specification which refer to the accompanying drawings. The drawings, however, are merely illustrative of how the invention might be put into effect, so that the specific form and arrangement of the various features as shown is not to be understood as limiting on the invention.

Figure 6:
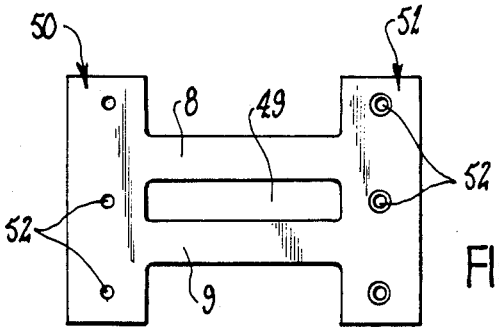
Figure 7:
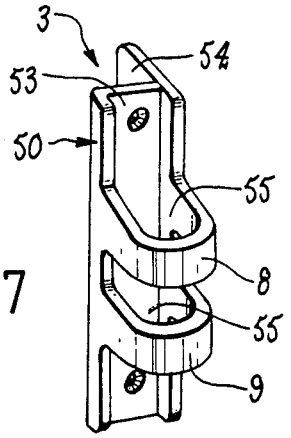
Figure 2:
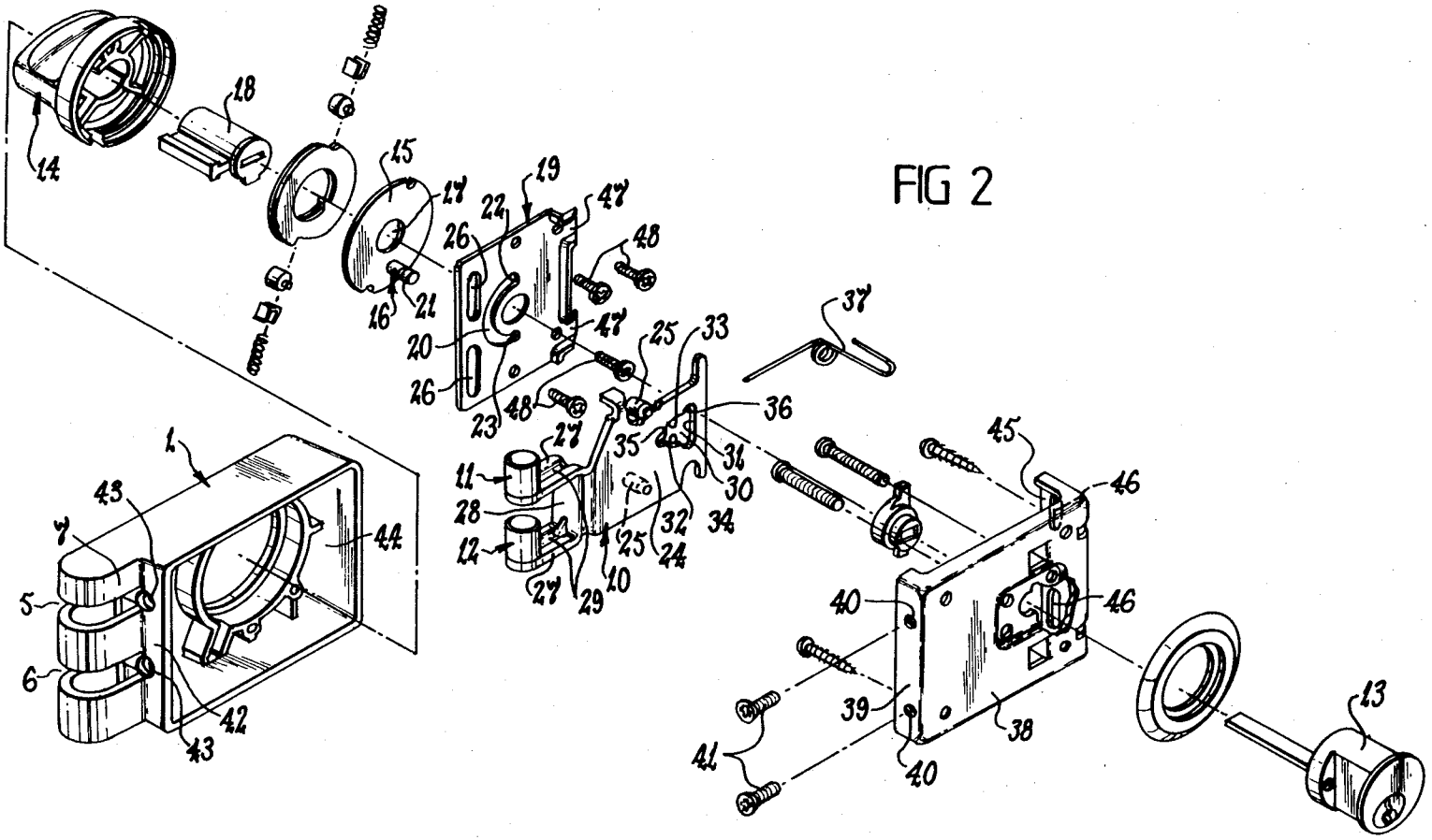
Figure 3:
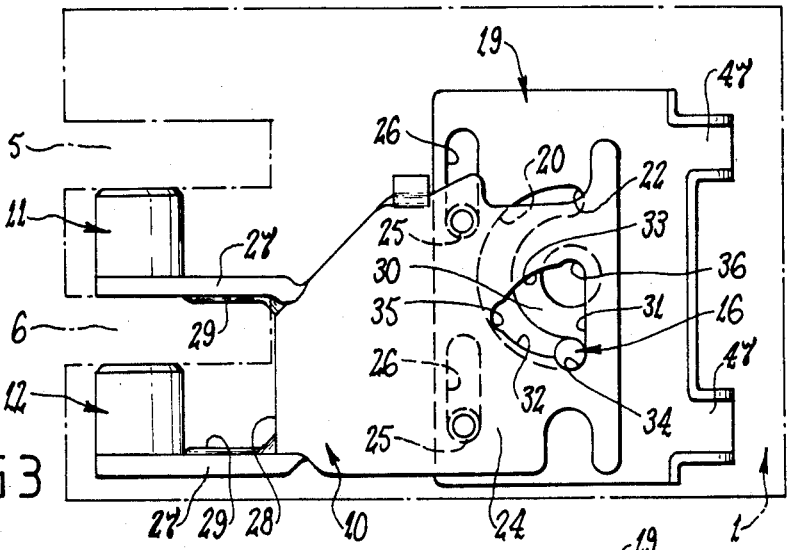
Figure 4:
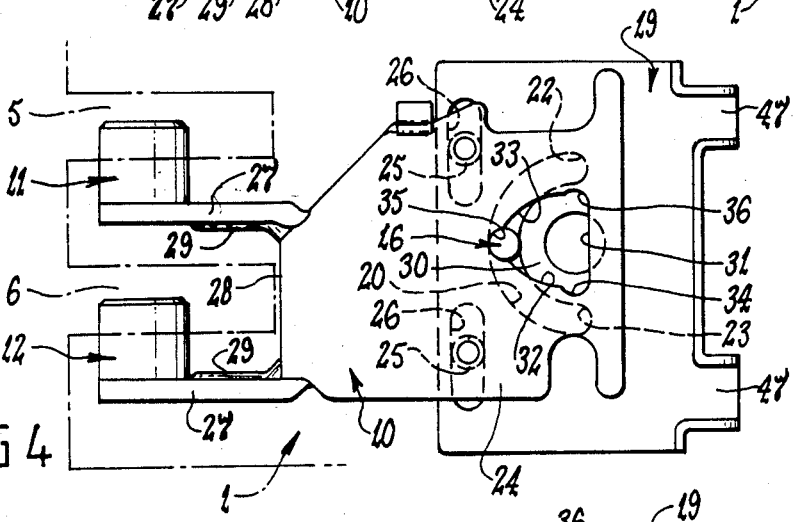
Figure 5:
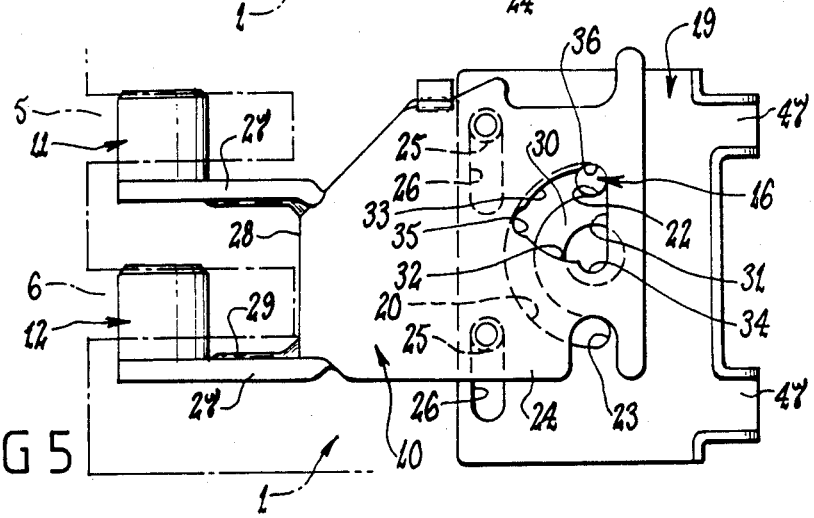

In the drawings:

FIG. 1 is a perspective view showing a typical deadbolt assembly to which the invention is applicable, FIG. 2 is an exploded perspective view of one embodiment of the invention, FIG. 3 is a view of critical components of the deadbolt mechanism as shown in FIG. 2, and showing the deadbolt in the inoperative position, FIG. 4 is a view similar to FIG. 3 but showing the deadbolt moving towards the operative position, FIG. 5 is a view similar to FIG. 3 but showing the deadbolt in the operative position, FIG. 6 is a view of a blank for forming a strike as shown in FIG. 1, FIG. 7 is a perspective view of an alternative form of strike.

The invention is applicable to deadbolt assemblies of various kinds, and FIG. 1 shows one such assembly. The arrangement of FIG. 1 includes a deadbolt housing 1 which is secured to a door 2 and a strike 3 which is secured to the door jamb 4. Two recesses 5 and 6 are provided in a projecting end 7 of the housing 1 and each is adapted to receive a respective one of the bars 8 and 9 of the strike 3. The deadbolt 10 (FIG. 2) has two parts 11 and 12, each of which extends across a respective one of the recesses 5 and 6 when the deadbolt 10 is in its operative position.

An assembly of the foregoing kind includes an inside actuator 14 and an outside actuator 13, both of which are shown in FIG. 2. The outside actuator 13 of the arrangement shown is a key operated lock, whereas the inside actuator 14 is in the form of a manually operable turn knob. The turn knob 14 is connected to a deadbolt 10 through a drive connection which includes a rotatable plate 15 and a drive pin 16 fixed to the plate 15 so as to move therewith and being located radially outwards from the axis of rotation of the plate 15.

In the arrangement shown, the drive plate 15 is in the form of a disc and a hole 17 is formed through the centre of the plate 15. That hole 17 enables a connection to be effected between the outside actuator 13 and another key operated lock which, in the construction shown, is mounted in the turn knob 14 to enable the deadbolt to be locked from the inside of the door.

It is preferred that the rotational movement of the plate 15 is guided by a guide plate 19 which is fixed to the housing 1. That plate 19 may have an arcuate slot 20 formed therein as shown, and the drive plate 15 and guide plate 19 are arranged in face to face relationship with the pin 16 extending through the guide slot 20. An end portion 21 of the pin 16 projects beyond the guide plate 19 for engagement with the deadbolt 10 or a member secured thereto. The arcuate slot 20 is preferably arranged so that its opposite ends 22 and 23 are located on a line extending substantially parallel to the path of movement of the deadbolt 10, and that line may substantially intersect with the axis of rotation of the plate 15.

The deadbolt 10 shown includes two cylindrical parts 11 and 12 arranged substantially coaxial and arranged in axially spaced relationship. As shown, those parts 11 and 12 are interconnected through a carrier plate 24 which is located at the side of the guide plate 19 remote from the drive plate 15. In the preferred form shown, the carrier plate 24 is pressed or stamped from a metal plate such as steel, and each deadbolt part 11 and 12 may be also formed from steel or a similar hard metal. Such deadbolt parts and their carriers have traditionally been cast from zinc, for example, and consequently have been relatively weak and suscepticle to breakage in the event of attempted forced actuation. A steel or similar hard metal arrangement as provided in the present construction is much more resistant to damage and is therefore more secure than prior constructions.

According to the particular construction shown, the main body of the carrier plate 24 is in substantially face to face relationship with the guide plate 19 and cooperates with that plate 19 or the housing 1 in such a way as to be held to a line of movement which extends substantially parallel to the axis of the deadbolt parts 11 and 12. That may be achieved by means of two guide pins 25 secured to the carrier plate 24 and slidably located in respective guide slots 26 formed through the guide plate 19. The guide pins 25 extend outwards from a face of the carrier plate 24 and are located in spaced relationship along a line extending substantially parallel to the axis of the deadbolt parts 11 and 12. Each of the cooperating slots 26 of the guide plate 19 extends in substantially the same direction as that line.

Each deadbolt part 11 and 12 is preferably secured to a respective arm 27 projecting laterally outwardly from an end of the body of the carrier plate 24. Those arms 27 are preferably integral with the body of the plate 24 and in the arrangement shown are bent from upper and lower ends respectively of a backwardly turned flange 28 of the carrier plate 24. Each arm 27 may be strengthened against deflection by being pressed, stamped or otherwise formed to have a longitudinally extending rib 29 therealong. The deadbolt parts 11 and 12 may be secured to their respective arms 27 by riveting or other appropriate procedure.

The drive pin 16 engages with the carrier plate 24 in such a way that the plate 24 moves as required in response to rotation of the drive plate 15. In the preferred arrangement shown, that engagement is achieved by having the pin 16 located within a cam opening 30 which is formed through the carrier plate 24. That opening 30 may be of triangular shape as shown, having an edge 31 extending upwards in the direction of the guide slots 26 and the other two edges 32 and 33 converge away from the upright edge 31 generally in a direction towards the deadbolt parts 11 and 12.

When the deadbolt 10 is in the inoperative position as shown in FIGS. 1 and 3, the drive pin 16 is located at the bottom end 23 of the arcuate slot 20 of the guide plate 19 and also at the lower end 34 of the upright edge 31 of the cam opening 30. If the plate 15 is then rotated to move the pin 16 along the arcuate slot 20, the pin 16 will also naturally travel towards the apex 35 of the converging edges 32 and 33 of the cam opening 30. At some stage (FIG. 4) in that movement the pin 16 engages the upper edge 33 of the cam opening 30 and thereafter pushes the carrier plate 24 upwards. Such upward movement of the carrier plate 24 moves the deadbolt parts 11 and 12 towards the operative position (FIG. 5) and that position is reached at or near the time when the pin 16 reaches the upper end 22 of the arcuate guide slot 20. At that time, the pin 16 will also be at the upper end 36 of the upright edge 31 of the cam opening 30.

As will be seen from FIGS. 2 to 5, the junction between each of the edges 31, 32 and 33 are preferably of arcuate form. It is further preferred that those junctions 34, 35 and 36 are arranged so that each provides a seating surface for the pin 16 such that movement of the pin 16 out of any one of the junctions 34, 35 and 36 is resisted. That is, each junction 34, 35 and 36 in effect forms a shallow recess in which the pin 16 seats or nests to an extent such that a force must be applied to overcome the restraining influence against movement of the pin 16 out of that recess.

The foregoing arrangement has the particular advantage that the pin 16 is positively located in the position at which the deadbolt 10 is operative. Also, the arrangement is such that the pin 16 positively holds the carrier plate 24 against forced movement into the inoperative position of the deadbolt 10. In particular, such movement of the carrier plate 24 can only be initiated by rotation of the plate 15 and that cannot be effected by applying a downward force to the deadbolt parts 11 and 12 or the arms 27 on which those parts 11 and 12 are mounted.

If desired, a spring 37 may act between the pin 16 and the carrier plate 24 so as to urge the pin 16 towards the upright edge 31 of the cam opening 30 and thereby ensure that the pin 16 normally locates in one of its extreme positions.

A further advantage of the improved deadlocking mechanism as described is that it permits the housing 1 to be fixed to a door 2 in a more secure manner than was previously possible. In the preferred arrangement shown, a mounting plate 38 of steel or other suitable metal is secured in any appropriate manner in face to face relationship with the inside surface of a door 2. An outwardly projecting flange 39 and 45 respectively is provided at each of the upright sides of that plate 38 and at least one fixing screw hole 40 is provided through the flange 39. Preferably, there are two such holes 40 in the flange 39 and they are spaced vertically apart. It is further preferred that the holes 40 in the flange 39 are screw threaded holes to cooperate with the thread of the fixing screws 41.

The mounting plate 38 is dimensioned so as to fit within the open back of the hollow housing 1 (FIG. 2) and in the assembled condition the front flange 39 preferably abuts against or lies close to the inner surface of an outer side wall 42 of the housing 1. That outer side wall 42 is the wall closest to the front edge of the door 2 and is provided with a pair of holes 43 which align with the holes 40 of the front flange 39. It is preferred that the rear flange 45 locates against or close to the inner side wall 44 of the housing 1.

It is preferred that the flange 45 is provided with two slots 46 which are adapted to receive respective lugs 47 provided on an edge of the guide plate 19. The plate 19 is fixed to the housing 1 by fastening screws 48 and consequently interaction between the lugs 47 and the slots 46 serve to assist in the firm retention of the housing 1 on the mounting plate 38.

The foregoing arrangement is such that the housing 1 is firmly secured to the door 2 and in such a manner that the fixing screws 41 are concealed from view and tampering while the door 2 is in a closed position.

The security of the assembly can be further improved by forming the strike 3 of sheet metal such as steel rather than die cast zinc as in the past. In the arrangement shown, the strike 3 is formed from a rectangular section of metal plate (FIG. 6) having a rectangular opening 49 therethrough so as to form two laterally spaced bars 8 and 9 which extend in the longitudinal direction of the plate section. As shown, the width of those bars 8 and 9 is reduced by removing an adjacent edge portion of the plate. Each of the opposite end portions 50 and 51 of the plate section can have a plurality of holes 52 therethrough for receiving fastening screws.

A plate section as described can be formed into an effective strike by bending that section intermediate the length of the bars 8 and 9 so that each bar 8 and 9 adopts a substantially U shape as shown in FIGS. 1 and 7. At least one end portion 50 of the plate section is bent along a line extending transverse to the bars 8 and 9 so as to form a mounting flange 53 which is disposed in opposed relationship to the base of the U-shaped bars 8 and 9. The other end portion 51 may be similarly bent in which event the two flanges 53 and 54 overlie one another as shown in FIG. 1. Alternatively, as shown in FIG. 7, the end portion 51 may be left to form a mounting flange 54 which is arranged substantially at right angles to the flange 53.

In a variation of the construction last described, sections of plate (not shown) between and outside of the bars 8 and 9 may project at right angles to the flange 54 so as to overlie the flange 53. Such an arrangement improves the security of the strike 3 because fastening screws can be passed through those plate sections and the underlying flange 53.

The strike 3 described above can be secured to a door jamb 4 by means of the mounting flanges 53 and 54 and in a position such that the U-shaped bars 8 and 9 are able to enter into respective front end recesses 5 and 6 of the deadbolt housing 1. The space 55 enclosed by each bar 8 and 9 thus forms an opening for receiving a respective part 11 and 12 of the deadbolt 10.

It will be appreciated that a strike 3 as described has substantially greater strength than prior die cast strikes and is therefore much more resistant to breakage. That feature when combined with other features as previously described in this specification results in an exceptionally secure deadbolt assembly.

Various alterations, modifications and/or additions may be introduced into construction and arrangements of parts previously described without departing from the spirit or ambit of the invention as defined by the appended claims.

Having now described our invention, what we claim as new and desire to secure by Letters Patent is:

1. A deadbolt assembly including, a housing, a deadbolt mounted on said housing for linear movement relative thereto between operative and inoperative positions, an actuator mounted on said housing, a drive plate rotatably mounted on said housing and being connected to said actuator so as to rotate in response to operation of said actuator, a drive pin fixed to said drive plate so as to move therewith and being located radially outwards from the axis of said plate rotation, the assembly being one wherein said pin travels through an arc during movement of said deadbolt between said positions thereof, and the extremities of said arcuate travel are located on a straight line which is substantially parallel to the path of said linear movement, and means on said deadbolt cooperating with said pin so that said pin is adapted to push against said deadbolt and thereby cause said linear movement thereof as said plate is rotated.

2. A deadbolt assembly according to claim 1, wherein said cooperating means is a non-circular opening provided in said deadbolt.

3. A deadbolt assembly according to claim 2, wherein said pin engages against a respective one of two said edges of said opening to cause said linear movement in each of two opposite directions, and said pin remains in engagement with a respective one of said two edges when said deadbolt is in said operative position and said inoperative position.

4. A deadbolt assembly according to claim 1, wherein said straight line substantially passes through said axis of rotation.

5. A deadbolt assembly according to claim 2, wherein said opening is substantially triangular having one edge which extends substantially in the direction of said linear movement and two further edges which converge away from said one edge, and said converging edges form said cooperating edges.

6. A deadbolt assembly according to claim 5, wherein an arcuate junction is provided between each two adjacent said edges.

7. A deadbolt assembly according to claim 5, wherein the junction between each said converging edge and said one edge is arranged to provide a seating surface for said pin such as to resist movement of said pin out of the respective junction, at least in one direction.

8. A deadbolt assembly according to claim 1, wherein a guide plate is fixed to said housing, an arcuate slot is formed through said plate, and said drive pin is slidably located within said slot and is guided by said slot during said drive plate rotation.

9. A deadbolt assembly according to claim 1, wherein said deadbolt includes a carrier plate and two cylindrical parts which are secured to said carrier plate so as to be substantially coaxial and arranged in axially spaced relationship, the axis of each said cylindrical part being substantially parallel to the direction of said linear movement.

10. A deadbolt assembly including, a housing, a deadbolt mounted on said housing for linear movement relative thereto between operative and inoperative positions, said deadbolt comprising a carrier plate and two cylindrical parts which are secured to said carrier plate so as to be substantially coaxial and arranged in axially spaced relationship, the axis of each said cylindrical part being substantially parallel to the direction of said linear movement, an actuator mounted on said housing, a drive plate rotatably mounted on said housing and being connected to said actuator so as to rotate in response to operation of said actuator, a drive pin fixed to said drive plate so as to move therewith and being located radially outwards from the axis of said plate rotation, and means on said deadbolt cooperating with said pin so that said pin is adapted to push against said deadbolt and thereby cause said linear movement thereof as said plate is rotated.

11. A deadbolt assembly according to claim 10, wherein said carrier plate is formed of metal plate, and said cylindrical parts are formed separately from said carrier plate and are secured to said carrier plate.

12. A deadbolt assembly according to claim 11, wherein said carrier plate includes two laterally projecting arms which extend substantially transverse to the direction of said linear movement and are spaced apart in that direction, and each said cylindrical part is secured to a respective said arm.

13. A deadbolt assembly according to claim 12, wherein each said arm has a longitudinal strengthening rib formed thereon.

14. A deadbolt assembly according to claim 1, wherein guide means functions to guide said deadbolt in said linear movement.

15. A deadbolt assembly according to claim 14, wherein said guide means includes a guide plate fixed to said housing, at least one guide slot in said guide plate which extends in the direction of said linear movement, and two guide pins secured to said carrier plate and each slidably located in said slot.

16. A deadbolt assembly according to claim 10, wherein guide means functions to guide said deadbolt in said linear movement, said guide means includes a guide plate fixed to said housing and interposed between said carrier plate and said drive plate, an arcuate slot is formed through said guide plate, and said drive pin is slidably located within said arcuate slot and is guided by said arcuate slot during said drive plate rotation.

17. A deadbolt assembly according to claim 1, wherein said housing is hollow, a mounting plate is located within an open back of said housing, and at least one fastening screw extends through a side wall of said housing and engages with said mounting plate to secure the housing to the mounting plate.

18. A deadbolt assembly according to claim 1 when combined with a strike formed of metal plate, said strike including a mounting flange for securing the strike to a support, and a pair of bars formed integral with said flange, each said bar being of substantially U-shape and being arranged so that the base of the respective U is in opposed relationship to said mounting flange, and a respective said part of said deadbolt is receivable in the space between said mounting flange and each said bar.

19. A combination according to claim 18, wherein each said bar has one end attached to a side edge of said mounting flange and the opposite end is attached to a further said mounting flange.

20. A combination according to claim 19, wherein said further mounting flange overlies the first said mounting flange in face to face relationship.

21. A combination according to claim 19, wherein said further mounting flange is arranged substantially at right angles to the first said mounting flange and extends beyond the face of the first said mounting flange which is opposite to said bars.

* * * * *